US005319853A

United States Patent [19]

Schmidt

[11] Patent Number: 5,319,853

[45] Date of Patent: Jun. 14, 1994

[54] SCRAPER

[75] Inventor: Sheldon Schmidt, Paramus, N.J.

[73] Assignee: Great Neck Saw Manufacturing, Inc., Mineola, N.Y.

[21] Appl. No.: 970,394

[22] Filed: Nov. 2, 1992

[51] Int. Cl.[5] ..... B26B 3/00; B26B 3/08

[52] U.S. Cl. ..... 30/169; 30/151

[58] Field of Search ..... 30/136, 151, 168, 169, 30/272, 389, 167; 7/124, 167

[56] References Cited

U.S. PATENT DOCUMENTS

| | | | |
|---|---|---|---|
| 2,800,672 | 7/1957 | Gilyan | 7/167 |
| 3,078,572 | 2/1963 | Everton | 30/169 |
| 4,675,996 | 6/1987 | DuBuque | 30/151 |
| 4,955,138 | 9/1990 | Henke et al. | 30/169 |
| 5,056,226 | 10/1991 | Gringer | 30/169 |
| 5,139,507 | 8/1992 | Dolgin et al. | 30/151 |

*Primary Examiner*—Richard K. Seidel
*Assistant Examiner*—Paul M. Heyrana, Sr.
*Attorney, Agent, or Firm*—Stoll, Miskin, Previto & Hoffman

[57] ABSTRACT

A scraper having a body portion with a front edge and a cover portion slidable relative to the body portion. The blade is received in the body portion with its cutting edge extending beyond the front edge of the body portion. The cover portion is movable relative to the body portion from a retracted position exposing the blade cutting edge to an extended position overlying the blade cutting edge. The cover portion is held in its retracted and/or its extended positions by locking mechanisms on the cover portion and on the body portion which cooperate with each other to hold the cover in its retracted and/or extended positions.

18 Claims, 2 Drawing Sheets

SCRAPER

BACKGROUND

The present invention relates to a scraper and more particularly to a scraper for use with a single edge razor blade.

Various types of scrapers have been designed over the years. In using a scraper that utilizes a razor blade, it is important that the bare blade be covered when the scraper is not in use in order to prevent the bare blade from injuring someone. In this connection, some prior scrapers place a blade in a retractable holder so that when the blade is not in use, the holder with the blade is retracted within a casing so as to hide the blade. Other scrapers use protective covers which are pivotally moved to a position to hide the exposed blade edge. Still other scrapers have covers which are moved over the blade and are locked in place by tightening of a set screw or some other device. Examples of these scrapers are shown and described in U.S. Pat. Nos. 2,336,284, 2,580,182 and 3,667,122. of scraping devices are shown in U.S. Pat. Nos. 4,189,829, 4,612,707 and 4,706,385.

OBJECTS

The present invention provides an improved scraper which has improved means for exposing or covering the blade of a single edge safety razor blade.

Another object of the present invention is the provision of an improved scraper which may be manufactured.

Another object of the present invention is the provision of an improved scraper in which the blade may be easily removed and replaced.

Another object of the present invention is the provision of an improved scraper which is lightweight and easy to handle.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

DESCRIPTION

Figure 1:
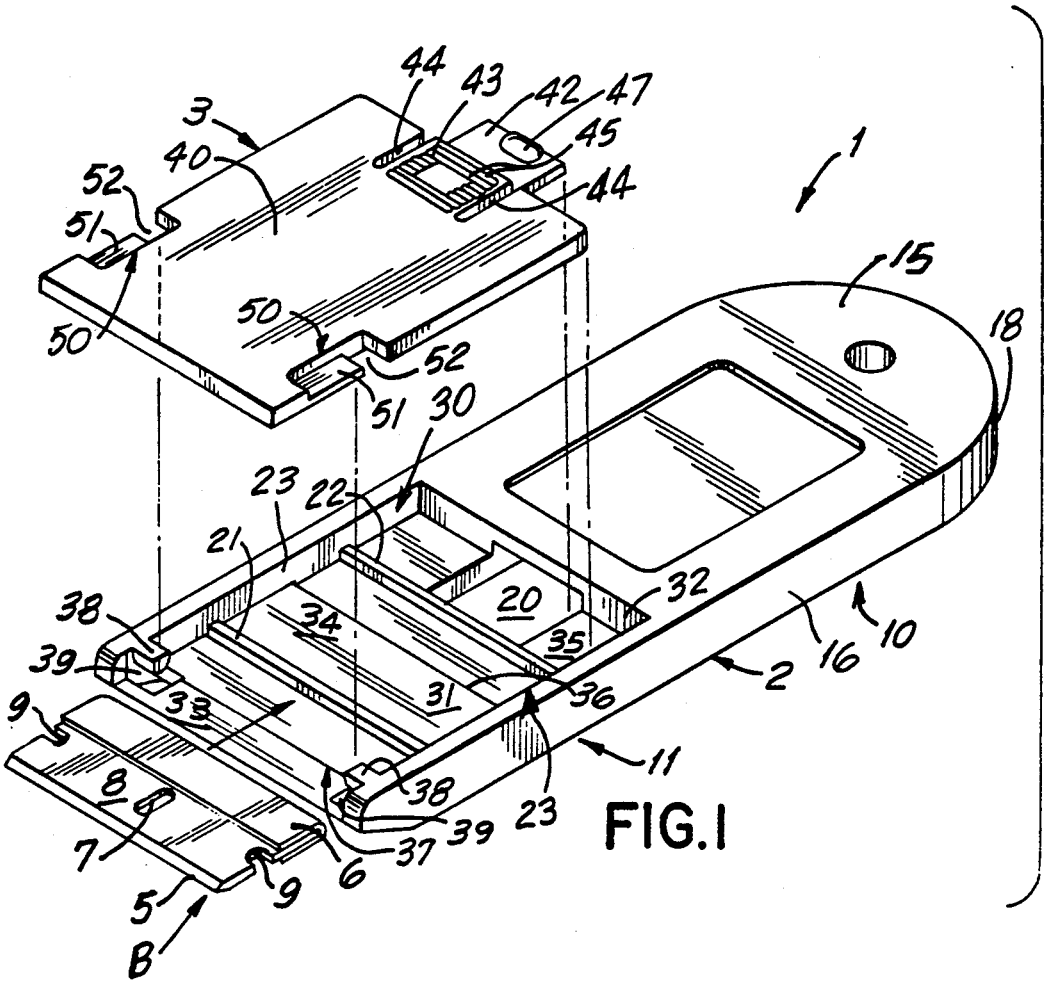
FIG. 1 is an exploded perspective view of the scraper of the present invention.
Figure 2:
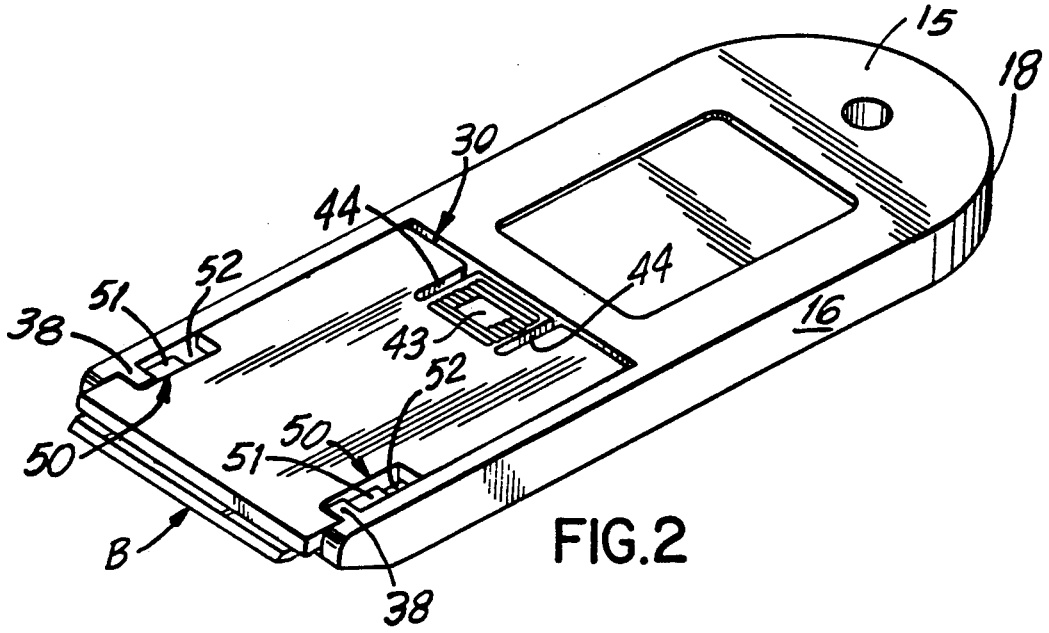
FIG. 2 is a perspective view of the scraper of the present invention in the active position.

Referring to the drawings, the scraper 1 of the present invention comprises a body portion 2 and a slidable cover portion 3 adapted to cooperate with the body portion 2 to cover or expose a single edge razor blade B.

The razor blade B to be used with the scraper 1 of the present invention is preferably a single edge razor blade B which has a metal body 8 with a cutting edge 5 at its front end and a back rib 6 on the other end to permit the blade to be grasped. The blade B may have an elongated opening 7 in the center of the body 8 and opposed notches 9 at the edges.

Both the cover 3 and the body portion 2 are preferably made of plastic and each may be manufactured in one piece by any well-known manufacturing operation. It will, of course, be understood that while the scraper 1 of the present invention will be described as being preferably made of plastic, it is within the purview of the present invention to make the scraper 1 of a material other than plastic.

Figure 3:
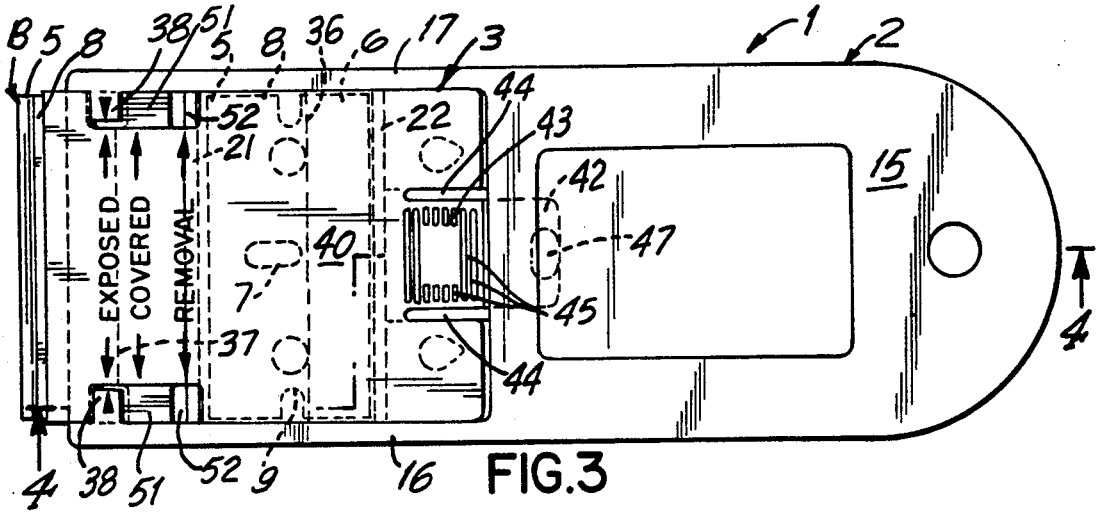
FIG. 3 is a top plan view of the scraper of the present invention.
Figure 4:
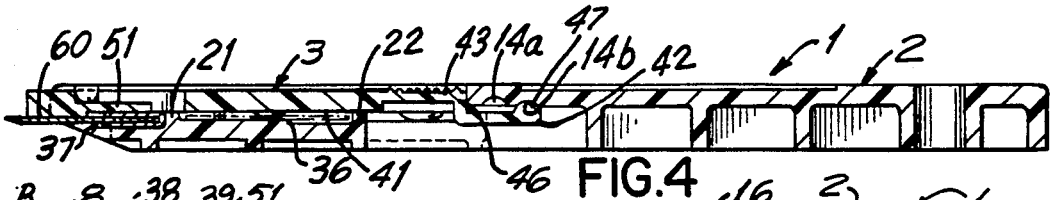
FIG. 4 is a sectional view taken along line 4—4 of FIG. 3.
Figure 5:
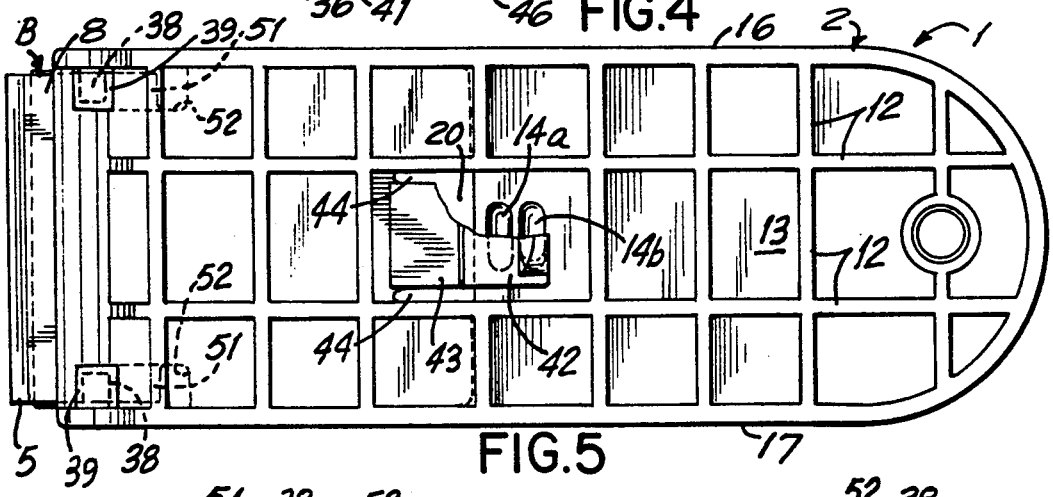
FIG. 5 is a bottom view of the scraper of the present invention.
Figure 6:
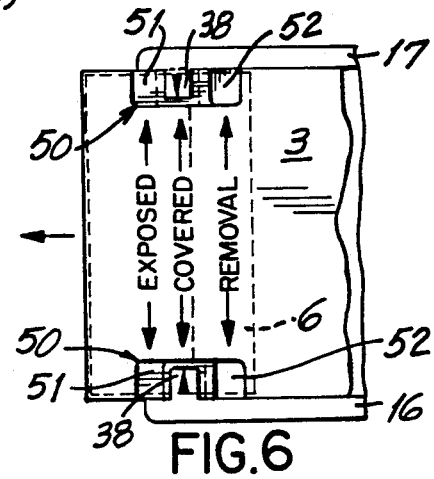
FIG. 6 is a fragmentary top view thereof showing the position of the parts when the blade edge is covered.
Figure 7:
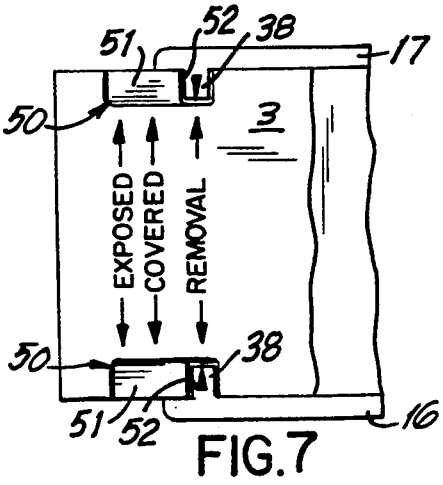
FIG. 7 is a top fragmentary view thereof showing the manner in which the cover may be removed.

The body portion 2 of the scraper 1 comprises a rear handle portion 10 and a front blade-receiving portion 11 which are shown in the drawing as being integral with each other. The body 2 is also provided with a pair of side walls 16 and 17 and a curved rear wall 18 joining the two side walls 16–17 together. The body 2 has a flat upper face 15 and a flat lower face 13 and is provided with a plurality of strengthening ribs 12 (FIGS. 3–4) extending from the lower face 13. The lower face 13 of the body is also provided with a plurality of indentations 14, to serve a purpose which will be further explained hereinafter. Preferably, the **14*a* and 14*b* are elongated and oriented the body 2. However, it will be understood that the indentations 14*a* and 14*b*** may assume a different and a different orientation and still be within the scope of the invention.

The front blade-receiving portion 11 of the body 2 comprises a cover-receiving cavity 30 which has a top surface 31 below the level of the top surface 15 of the rear handle portion 10 and is comprised of a rear wall 32, a pair of side walls 23, an open front 33. The cavity 30 is separated by transverse walls 21 and 22 into forward, middle and rear areas 33, 34 and 35 respectively. The rear area 35 has a central opening 20 therein. The middle area 34 has a transverse ledge 36 and the forward area 33 is also provided with a transverse ledge 37. The forward area 33 receives a blade B which is held in place with its back 6 held in place behind the ledge 37. The middle area 34 is adapted to hold a spare blade B with its back 6 held in place behind ledge 36. The forward area 33 of the cavity 30 is with retainer lugs 38 extending inwardly from the top of the side walls 23 but spaced above the cavity floor 31 to leave a space 39 between the floor 3 and the lugs 38.

The cover portion 3 is slidably mounted in the blade-receiving cavity 30 of the front body portion 11. The cover portion 3 has a flat top face 40 and a flat bottom face 41 which terminates in a shelf 60 at its front end. A lock finger 42 extends rearwardly from the cover portion 3 in a plane below the plane of the top surface 40 and extends through the opening 20 in the handle portion 10 so as to underlie the front end of the handle portion 12. The lock finger 42 extends from a resilient thumbpiece 43 which is formed by cutting a pair of elongated notches 44 in the rear of the cover 3 to give the thumbpiece resiliency. The thumbpiece 43 may be provided with grip ribs 45 and is connected to the lock finger 42 by a depending strap 46 which allows the lock finger to be below the level of the cover 3 and to underlie the rear handle portion 10.

The upperside of the lock finger 42 is provided with an elongated transverse rib 47 adapted to be inserted in and cooperate with the two indentations 14*a* and 14*b* in the lower face 47 of the rear portion 10 in order to lock the cover 3 in the proper position. The lower surface 41 of the cover 3 has a plurality of spaced 48 and 49 which are adapted to apply pressure to a blade B in the blade-receiving cavity.

The side edges of the cover 3 each have a pair of elongated notches 50 each of which comprise lock tab 51 extending therefrom and located at a level below the top surface 40 of the cover 3. The lock tabs 51 terminate short of rear of the notches 50 in the cover 30 to form openings 52. The lock tabs 51 are adapted to be inserted and are locked in place below the lugs 38 extending from the inner walls 23 of the blade-receiving cavity 30 in order to hold the front of the cover 3 in place on the handle. The cover 3 is slidably held in place at the front by the lock tabs 51 beneath lugs 38 and the rear finger 42 mounted within one of the indentations 14*a* or 14*b*.

When the scraper 1 is to be assembled together, a blade B is placed in the blade-receiving cavity 30 with its body 8 mounted beneath the lock lugs 38 in the space 39 therebeneath and the back 6 held in place between transverse wall 21 and transverse ledge 37. The cover 3 is then slipped over the front of the handle 12 so that the rear extending finger 42 is moved into the opening 20 and is mounted below the forward part 11 of the handle portion with its protrusion 47 mounted in one or the other of the indentations 14*a* and 14*b*. The front of the cover 3 is held in place by the lock tabs 50 beneath the lugs 38. With this structure, the blade B may be exposed by moving the cover 3 back so that the rear protrusion 47 enters into the rear indentation 14*b*. The blade B may then be covered by moving the cover 3 forward so that the rear portion 47 enters into the front indentation 14*a*. The shelf 60 will cover the entire blade so that it is not exposed.

When it is desired to remove the cover in order to change the blade, the rear finger 42 is moved downwardly so that the protrusion 47 becomes disengaged from the indentations 14*a* or 14*b* and the cover is moved so that the openings 52 are now in line with the lugs 38 in the handle. In this position, the cover 3 can be removed by moving the openings 52 through the lugs 38 and new blades placed in the scraper. After this is accomplished, the cover 3 can be reassembled by placing it so that the openings 52 overlie the lugs 38 and pressing the cover 3 down to move the lugs 38 through the openings 52 and moving the cover 3 rearwardly so that the lock tabs 51 are in the space 39 beneath the lugs 38 in order to lock the cover 3 in place.

It will thus be seen that the present invention provides an improved scraper which has improved means for exposing or covering the blade of a single edge safety razor blade which may be inexpensively manufactured, in which the blade may be easily removed and replaced and which is lightweight and easy to handle.

Other and further objects of the invention will be obvious upon an understanding of the illustrative embodiment about to be described, or will be indicated in the appended claims and various advantages not referred to herein will occur to one skilled in the art upon employment of the invention in practice.

The embodiments of the invention in which an property or privilege is claimed are defined as follows:

1. A scraper comprising a body portion having a front edge and a cover portion slidable relative to said body portion, means in said body portion for receiving a blade with its cutting edge extending beyond the front edge of the body portion, said blade being interposed between the said body portion and said cover portion means for moving the cover portion relative to the body portion from a retracted position exposing the blade cutting edge to an extended position overlying the blade cutting edge, means for holding the cover portion in its retracted position, said holding means adapted to hold the cover in its extended positions, said holding means comprising locking means on the cover portion and locking means on the body portion cooperating with each other to hold the cover portion in said retracted and extended positions, said locking means on the cover portion comprising first and second lock means and said locking means on the body portion comprising first and second lock means cooperating respectively with said first and second lock means of the cover portion, said first and second lock means of the cover portion spaced from each other and said first and second lock means on the body portion spaced from each other, said cooperating first lock means comprising protrusion means and indentation means cooperating with each other and said cooperating second lock means comprising lock lug means and lock tab means cooperating with each other.

2. A scraper as set forth in claim 1 wherein the blade receiving means in the body portion has an upper face, side walls and rear walls.

3. A scraper as set forth in claim 2 wherein said first lock means comprise a lock finger on said cover portion having one of said protrusion/indentation cooperating means and the body portion having the other said cooperating means.

4. A scraper as set forth in claim 3 wherein said lock finger is a resilient finger.

5. A scraper as set forth in claim 4 wherein said finger extends rearwardly from the rear of the cover portion.

6. A scraper as set forth in claim 5 wherein said resilient finger is attached to thumbpiece formed by a pair of slots cut in the cover portion.

7. A scraper as set forth in claim 6 wherein said resilient finger has at least a portion below the upper surface of the cover portion.

8. A scraper as set forth in claim 7 wherein said portion extends through an opening in the receiving means to a position below the lower surface of the body portion and wherein the other cooperating means is located.

9. A scraper as set forth in claim 8 wherein protrusion means are provided in said resilient finger wherein indentation means are provided in the lower surface of said body portion.

10. A scraper as set forth in claim 9 wherein a pair of indentations are provided longitudinally spaced from each other and wherein the protrusion is inserted in one of the extensions depending on whether the cover is in its extended or retracted position.

11. A scraper as set forth in claim 2 wherein said second lock means comprise lock tabs on the cover portion and lock lugs on the body portion.

12. A scraper as set forth in claim 11 wherein said lock lugs are spaced above the upper surface of the body portion with the lock tabs adapted to be slidably mounted beneath the lock lugs.

13. A scraper as set forth in claim 12 wherein the thickness of said lock tabs is less than the thickness of the cover portion.

14. A scraper as set forth in claim 13 wherein the lock tabs extend for a distance less than the distance of the cover portion.

15. A scraper as set forth in claim 14 wherein said lock tabs are formed along the side edges of the cover portion.

16. A scraper as set forth in claim 15 wherein openings are formed in the cover portion where the lock tabs terminate.

17. A scraper as set forth in claim 16 wherein the lock lugs are formed adjacent the open front of the body portion.

18. A scraper as set forth in claim 17 wherein said cover portion is movable to a removal position where the lock tabs are moved to a position forwardly of the lugs to permit the cover to be removed by moving the openings past the lugs.

* * * * *